US006902427B2

(12) United States Patent
Kuo

(10) Patent No.: US 6,902,427 B2
(45) Date of Patent: Jun. 7, 2005

(54) INTEGRATED S-VIDEO AND COMPOSITE VIDEO PORT

(75) Inventor: Yi-Lung Kuo, Keelung (TW)

(73) Assignee: Shuttle Inc. (TW)

( * ) Notice: Subject to any disclaimer, the term of this patent is extended or adjusted under 35 U.S.C. 154(b) by 0 days.

(21) Appl. No.: 10/783,997

(22) Filed: Feb. 20, 2004

(65) Prior Publication Data

US 2004/0229514 A1 Nov. 18, 2004

Related U.S. Application Data

(60) Provisional application No. 60/456,639, filed on Mar. 20, 2003.

(51) Int. Cl.[7] ..... H01R 11/00
(52) U.S. Cl. ..... 439/502; 439/638; 439/623
(58) Field of Search ..... 439/502, 505, 439/623, 638

(56) References Cited

U.S. PATENT DOCUMENTS 4,902,092 A * 2/1990 Grandy ..... 385/56
6,280,243 B1 * 8/2001 Liu et al. ..... 439/502
6,514,092 B1 * 2/2003 Chiu ..... 439/79
6,672,896 B1 * 1/2004 Li ..... 439/502

* cited by examiner

*Primary Examiner*—Truc Nguyen
(74) *Attorney, Agent, or Firm*—Fenwick & West LLP

(57) ABSTRACT

A terminal assembly for a personal computer integrates an S-video and a composite video terminal into a single socket on an electronic device. The socket includes inlets for separately carrying S-video and composite video signals. The socket can be connected to provide an S-video signal to another device using a standard S-video cable. Alternatively, the socket can be connected to provide a composite video signal using an adaptor that has two terminals: one for mating with the socket and coupling with the composite video inlets thereon, and the other for providing a standard composite video connection.

7 Claims, 1 Drawing Sheet

INTEGRATED S-VIDEO AND COMPOSITE VIDEO PORT

CROSS REFERENCE TO RELATED APPLICATIONS

This application claims the benefit of U.S. Provisional Application No. 60/456,639, filed Mar. 20, 2003, which is hereby incorporated in its entirety by reference.

BACKGROUND

1. Field of the Invention

The invention relates to connecting video signals between electronic devices, and in particular to connecting a personal computer to display devices using S-video and/or composite video terminals.

2. Background of the Invention

Personal computers commonly offer video and audio output terminals or ports to facilitate multimedia processing. Some of these terminals are integrated on interface cards, while others are integrated on the motherboard of the computer. As integrated circuit technology develops, integrated circuits offer more powerful performance in smaller chips. Accordingly, more integrated circuits, such as networking, modem, graphic processing, and sound chips, can be integrated onto the motherboard. It is, however, a challenge to integrate these devices on the motherboards without increasing the size of the motherboard. For this reason, some personal computer manufacturers add composite video terminals on their motherboards. But such terminals allow connections only to electronic devices that also have composite video terminals, while other computers may allow connections only for standard four-pin S-video terminals. Therefore, adaptors are required to connect these terminals to electronic devices with only composite video terminals. However, adapters for converting video signals between composite video and S-video are large in size and complicated to use.

SUMMARY OF THE INVENTION

Accordingly, a terminal assembly for an electronic device integrates an S-video and a composite video terminal into a single socket on a personal computer. The socket, combined with an adapter, allows the computer to be connected to electronic devices that have either an S-video or a composite video terminal. Integrating the S-video and composite video terminals saves space on the motherboard of the computer while allowing flexibility in connecting the computer to input or output video signals to or from external video devices.

In one embodiment, a terminal assembly includes a socket in an electronic device that combines an S-video terminal and a composite video terminal in a single structure. The socket includes at least six inlets, four of which implement a standard four-pin S-video terminal with respect to pin definition and position, and two or more of which carry the signals for a standard composite video signal. To allow for connection to a composite video device, the assembly includes an adaptor that has a terminal for mating with the S-video-shaped socket. Although this terminal can mate with the S-video socket, it has electrical conductors therein for carrying the composite video signal from the socket to a composite video terminal of the adapter (e.g., at the opposite end of a cable). Accordingly, when the adaptor is plugged into the socket, the computer can be connected via the composite video terminal to electronic devices that have a composite video terminal. Meanwhile, the computer can be connected to electronic devices that have a four-pin S-video terminal using a standard S-video cable.

DETAILED DESCRIPTION OF THE PREFERRED EMBODIMENTS

Figure 1:
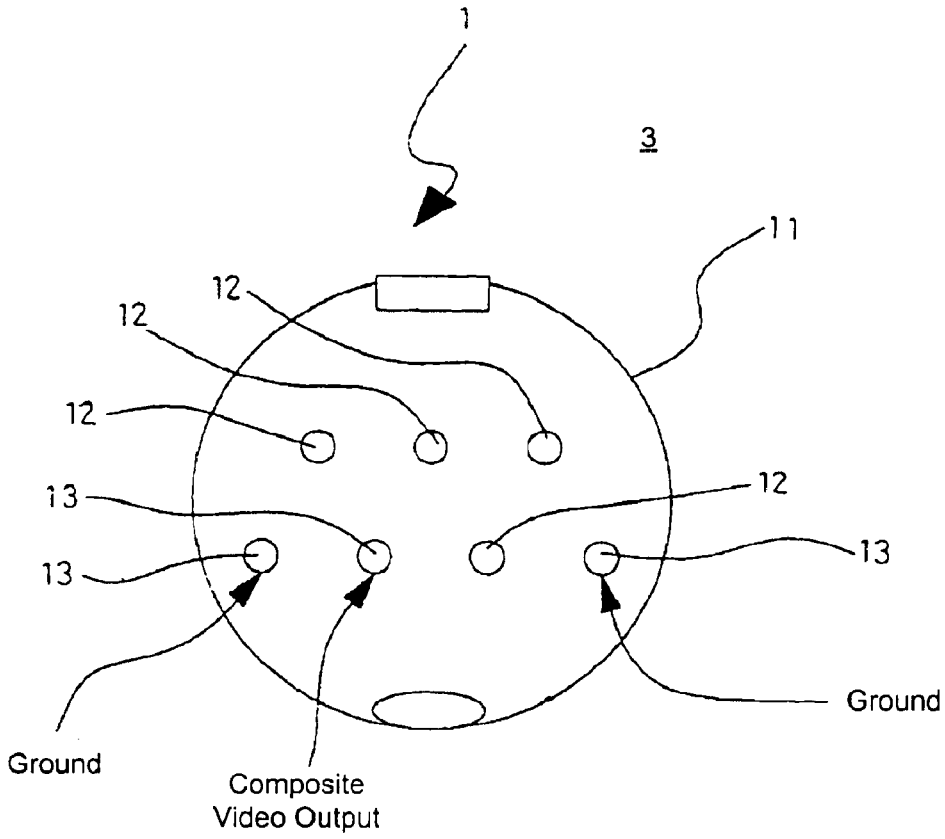
FIG. 1 shows a video terminal socket in accordance with an embodiment of the invention.

One embodiment of a video terminal socket 1 in accordance with the invention is shown in FIG. 1. The socket 1 is formed on a personal computer 3 (or other electrical device) to allow the computer 3 to be connected to receive or provide a video signal to an external device (not shown). In a typical implementation, the socket 1 is located on an outside panel of the computer 3 and electrically coupled to exchange video signals with the motherboard of the computer 3. The personal computer 3 may provide a video signal, for example, to a display device, such as a television. Alternatively, the socket 1 may allow the computer 3 to receive a video signal, for example, from a DVD player for display on the computer's display.

The terminal socket 1 includes a base 11 that offers the socket 1 a fixture and shields external electromagnetic interference. The socket 1 also includes two sets of inlets 12 and 13. A first set of four inlets 12 are compatible with a standard four-pin S-video terminal in terms of position and electrical connectivity. These inlets 12 allow the computer to be connected to another electronic device using a standard S-video cable. A second set of inlets 13 include ground and composite video output conductors. This set of inlets 13 allow for connection of the personal computer 3 via the socket 1 to electronic devices that have only standard composite video terminals. As shown in FIG. 1, the second set of inlets 13 include at least a ground and a composite video output conductors; however, additional conductors for ground may be used. In this way, a single socket 1 can provide an S-video signal and/or a composite video signal.

Figure 2:
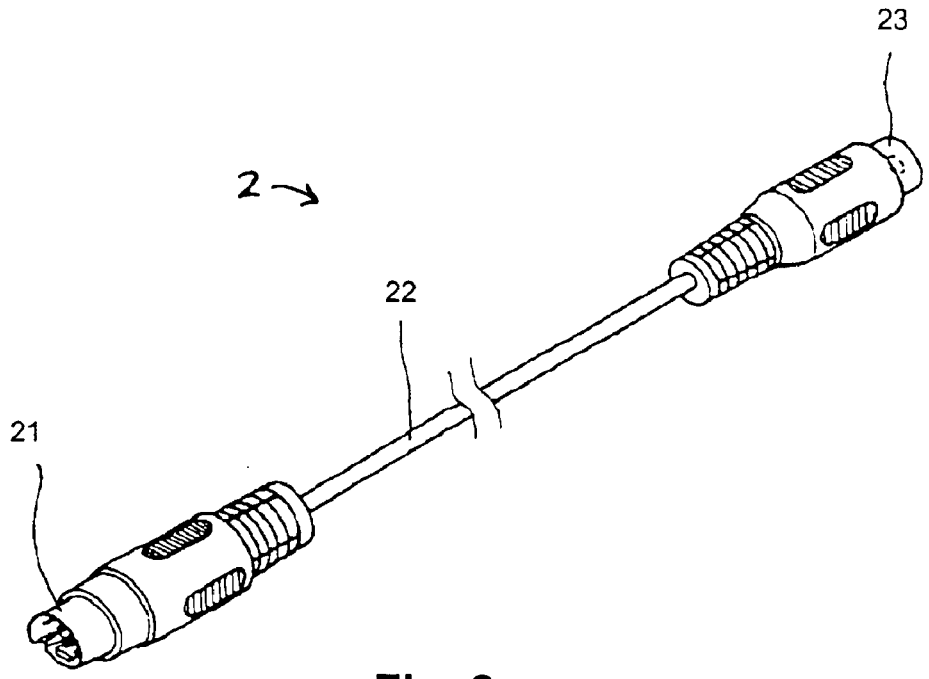
FIG. 2 shows an adaptor in accordance with an embodiment of the invention.

FIG. 2 shows an adaptor 2 for coupling the computer via the socket 1 to an external device that has only a composite video terminal, in accordance with an embodiment of the invention. The adaptor 2 includes a terminal 21 that is shaped to mate with the socket 1, e.g., like a standard S-video terminal. However, the terminal 21 has conductors for coupling to the composite inlets 13 of the socket 1 so the adapter 2 can carry the composite video signal. The adapter 2 also includes a composite video terminal 23 and a cable 22 that couples the two terminals 21 and 23. In this way, when the terminal 21 is attached to the socket 1, the cable 22 electrically connects the ground and composite video conductors of the second set of inlets 13 to the appropriate ground and video conductors of the composite video terminal 23.

In operation, to connect the personal computer 3 with the socket 1 to a video device having only an S-video terminal, a user would connect the S-video terminal of the device to the socket 1 using a standard S-video cable. This has the effect of coupling an S-video signal processed by the personal computer 3 to the device.

Alternatively, to connect the personal computer 3 with the socket 1 to an electronic device having only a composite video terminal, a user would connect the terminal 23 of the adaptor 2 to the socket 1. Then, the user would connect the composite video terminal 21 of the adapter 2 to the device so that video signals processed by the personal computer 3 would be provided to the device.

Combining the S-video and composite video terminals in a single socket 1 of a computer achieves several advantages. For example, integrating the terminals in this way saves space because it only requires a single port on the motherboard of the computer 3 or other electrical device. In addition, using the adaptor 2 allows the personal computer 3 to be connected to other electronic devices that have only an S-video terminal and/or to other electronic devices that have only composite video terminals. Moreover, the adaptor 2 is easy to use and is not bulky, complicated, or expensive because it need not actually convert an S-video signal to a composite video signal.

The foregoing description of the embodiments of the invention has been presented for the purposes of illustration and description. It is not intended to be exhaustive or to limit the invention to the precise forms disclosed. Persons skilled in the relevant art can appreciate that many modifications and variations are possible in light of the above teaching. It is therefore intended that the scope of the invention be limited not by this detailed description, but rather by the claims appended hereto.

I claim:

1. An integrated S-video and composite video terminal assembly for an electronic device, comprising:

a socket having first and second sets of inlets, the first set of inlets compatible with a standard S-video terminal and the second set of inlets for carrying a composite video signal, and an adaptor having first and second terminals, the first terminal configured to mate with the socket and couple to the second set of inlets, the second terminal coupled to the first terminal and compatible with a standard composite video terminal.

2. The assembly of claim 1, wherein the second set of inlets include a ground conductor and a composite video output conductor.

3. The assembly of claim 1, wherein the first and second terminals of the adaptor are connected by a cable.

4. The assembly of claim 1, wherein the first set of inlets of the socket are coupled to a video processor for receiving an S-video signal.

5. The assembly of claim 1, wherein the second set of inlets of the socket are coupled to a video processor for receiving a composite video signal.

6. The assembly of claim 1, wherein the first terminal of the adaptor is a male connector.

7. The assembly of claim 1, wherein the second terminal of the adaptor is a male connector.

* * * * *